US008801552B2

(12) United States Patent
Miles

(10) Patent No.: US 8,801,552 B2
(45) Date of Patent: Aug. 12, 2014

(54) BROADHEAD ARROW TIP AND ASSOCIATED METHODS

(71) Applicant: Christopher Ray Miles, Springville, UT (US)

(72) Inventor: Christopher Ray Miles, Springville, UT (US)

( * ) Notice: Subject to any disclaimer, the term of this patent is extended or adjusted under 35 U.S.C. 154(b) by 0 days.

(21) Appl. No.: 13/737,952

(22) Filed: Jan. 10, 2013

(65) Prior Publication Data

US 2014/0194234 A1 Jul. 10, 2014

(51) Int. Cl.
*F42B 6/08* (2006.01)

(52) U.S. Cl.
USPC ..... 473/583

(58) Field of Classification Search
USPC ..... 473/583, 584
See application file for complete search history.

(56) References Cited

U.S. PATENT DOCUMENTS

| | | | | |
|---|---|---|---|---|
| 5,941,784 | A * | 8/1999 | Mizek | 473/584 |
| 8,147,361 | B1 * | 4/2012 | Weaver | 473/583 |
| 8,182,378 | B1 * | 5/2012 | Futtere | 473/583 |
| 8,469,842 | B2 * | 6/2013 | Mizek et al. | 473/583 |

* cited by examiner

*Primary Examiner* — John Ricci
(74) *Attorney, Agent, or Firm* — Robert L. Lundstrom

(57) ABSTRACT

A blade-opening arrowhead device includes an arrowhead body having a plurality of longitudinal blade slots on an outer surface and a flexible wedge slot extending through a center portion of the body. A blade is pivotally disposable in one of the blade slots and pivotable between a retracted position and a deployed position. A flexible wedge is disposable in the flexible wedge slot. The flexible wedge is configured to apply a wedging force against the blade in the retracted position to maintain the blade in the retracted position until a sufficient external force overcomes the wedging force and pivots the blade to the open position.

19 Claims, 12 Drawing Sheets

BROADHEAD ARROW TIP AND ASSOCIATED METHODS

BACKGROUND OF THE INVENTION

1. Field of the Invention

The present invention relates generally to archery products and more particularly to mechanical broadhead arrow tips.

2. Related Art

Many mechanical broadhead arrow tips have movable blades that can be stowed during flight and deploy upon impact. The blades are stowed during flight to provide aerodynamic stability to the arrow during flight. Upon impact the blades are deployed to an extended position that enlarges the cutting profile of the arrow tip.

Some mechanical broadhead arrow tips use an expendable retention device to retain the movable blades in the stowed position. Such expendable retention devices usually need to be replaced after each use of the arrow. For example, some broadheads use an elastomeric o-ring that that stretches around the outside of the arrowhead and exerts a resistive force against the blades to hold the blades in the stowed position. When the arrow impacts its target the impact can cause the blades to cut the o-ring so that the blades can pivot into the extended position.

Unfortunately, broadhead arrow tips using such expendable retention devices can cause a number of problems for avid archers. For example, the retention devices can fail prematurely due to operating conditions such as environmental exposure, extreme velocities of the arrows, and the like. It will be appreciated that premature failure of the retention device can cause aerodynamic problems for the arrow in flight, which may result in target loss, non-lethal wounding of prey and laceration hazards to the archer. Moreover, expendable retention devices need to be replaced after every use which increases the costs and decreases the efficiency of the broadhead to the archer.

Another problem of many broadhead arrow tips is they have multiple moving parts that can cause balance and aerodynamic problems for the arrow in flight. Additionally, having many moving components in one arrow tip generally increases the amount of kinetic energy needed in order to deploy the blades. Using kinetic energy to deploy the blades reduces the amount of energy available to the arrow for penetrating a target. Moreover, many moving parts can increase the overall manufacturing costs of the arrow.

Yet another problem with some mechanical broadhead arrow tips is that the blades can vibrate during flight which can cause a whistling noise as the arrow flies. Such noises have been known to startle animals, causing them to bolt and leaving the bow hunter without a kill.

SUMMARY OF THE INVENTION

The inventor of the present invention has recognized that it would be advantageous to develop a mechanical broadhead arrow tip that has re-usable means for retaining movable blades in a stowed position during flight and allows the blades to move to an extended position upon impact. Additionally, the inventor has recognized that it would be advantageous to develop a mechanical broadhead arrow tip that minimizes the moving parts so as to reduce weight and manufacturing complexity of the arrow tip. Furthermore, the inventor has recognized that it would be advantageous to develop a broadhead arrow tip that wedges the deployable blades against the arrow head body so as to reduce and minimize vibration of the blade during flight.

The invention provides a blade-opening arrowhead device including an arrowhead body having a plurality of longitudinal blade slots on an outer surface and a flexible wedge slot extending through a center portion of the body. A blade is pivotally disposable in one of the blade slots and pivotable between a retracted position and an deployed position. A flexible wedge is disposable in the flexible wedge slot. The flexible wedge is configured to apply a wedging force against the blade in the retracted position to maintain the blade in the retracted position until a sufficient external force overcomes the wedging force and pivots the blade to the open position.

In accordance with one aspect of the present invention, the flexible wedge includes a contact tab sized, shaped and positioned to exert a wedging force against the blade in the retracted position.

In accordance with another aspect of the present invention, the flexible wedge includes a pair of opposing contact tabs sized, shaped and positioned to exert a wedging force against opposite sides of the blade in the retracted position.

The present invention also provides for a method for making a blade-opening arrowhead device including obtaining an arrowhead body. A pivotal blade can be attached to the arrowhead body with the blade pivotable between a stowed position with the blade at least partially disposed within the arrowhead body and a deployed position with the blade extending away from the arrowhead body. A flexible wedge can be placed within the arrowhead body such that the flexible wedge contacts the blade in the stowed position and wedges the blade against an opposing surface.

The present invention also provides for a method for using a blade-opening arrowhead device including coupling an arrowhead body to an arrow shaft. A blade disposed on the arrowhead body can be pivoted from an open position to a retracted position. A flexible wedge can be engaged against the blade in the retracted position to provide a wedging force against the blade.

Additional features and advantages of the invention will be apparent from the detailed description which follows, taken in conjunction with the accompanying drawings, which together illustrate, by way of example, features of the invention.

DETAILED DESCRIPTION

Figure 1:
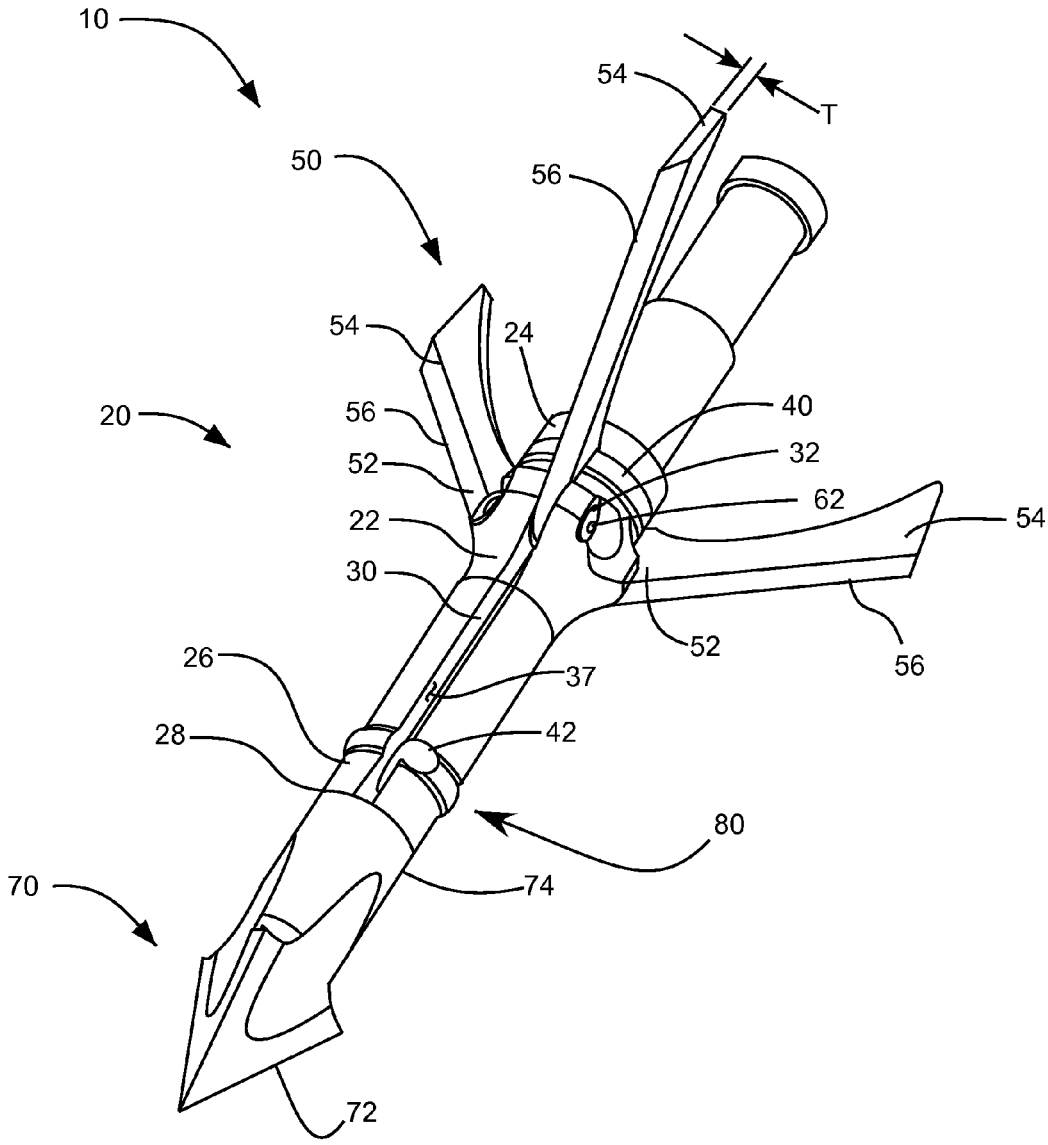
FIG. 1 is a perspective view of a blade-opening arrowhead device in accordance with an embodiment of the present invention, shown with a plurality of blades in an deployed configuration.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The embodiments of the present invention described herein generally provide for a broad head arrow tip with extendable blades that move between a retracted, stowed position and an extended, deployed position. During flight the blades are positioned and retained in the retracted position. Upon impact, as the arrow head travels through a target, the blades are deployed to the extended position thereby increasing the cutting size of the broadhead tip. The blades are retained in the retracted position by mechanical force exerted on the blade by a flexible wedge that can clamp or wedge the blade between the flexible wedge and a groove or slot on the arrowhead body. The flexible wedge provides a retentive wedging force to the blade and holds the blade in the retracted position during flight. Upon impact, the blade can be snagged by target material as the arrow head penetrates a target and the forces on the blade from the target material can overcome the wedging forces from the flexible wedge so that the blade can move into the extended, open or deployed position.

As illustrated in FIGS. 1-6, a blade-opening arrowhead device, indicated generally at 10, is shown in accordance with an embodiment of the present invention for use in increasing the cutting diameter of the arrowhead device. The arrowhead device can include an arrowhead body, indicated generally at 20, and a plurality of blades, indicated generally at 50, and a flexible wedge, indicated generally at 80.

The arrowhead body 20 can be generally cylindrically shaped with a rearward portion 22 extending to a rearward end 24 and a forward portion 26 extending to a forward end 28. The arrowhead body 20 can have a plurality of blade slots 30 that can extend longitudinally between the rearward end 24 and the forward end 28. Each blade slot 30 can have a corresponding pivot pin hole 32 near the rearward end.

Figure 3:
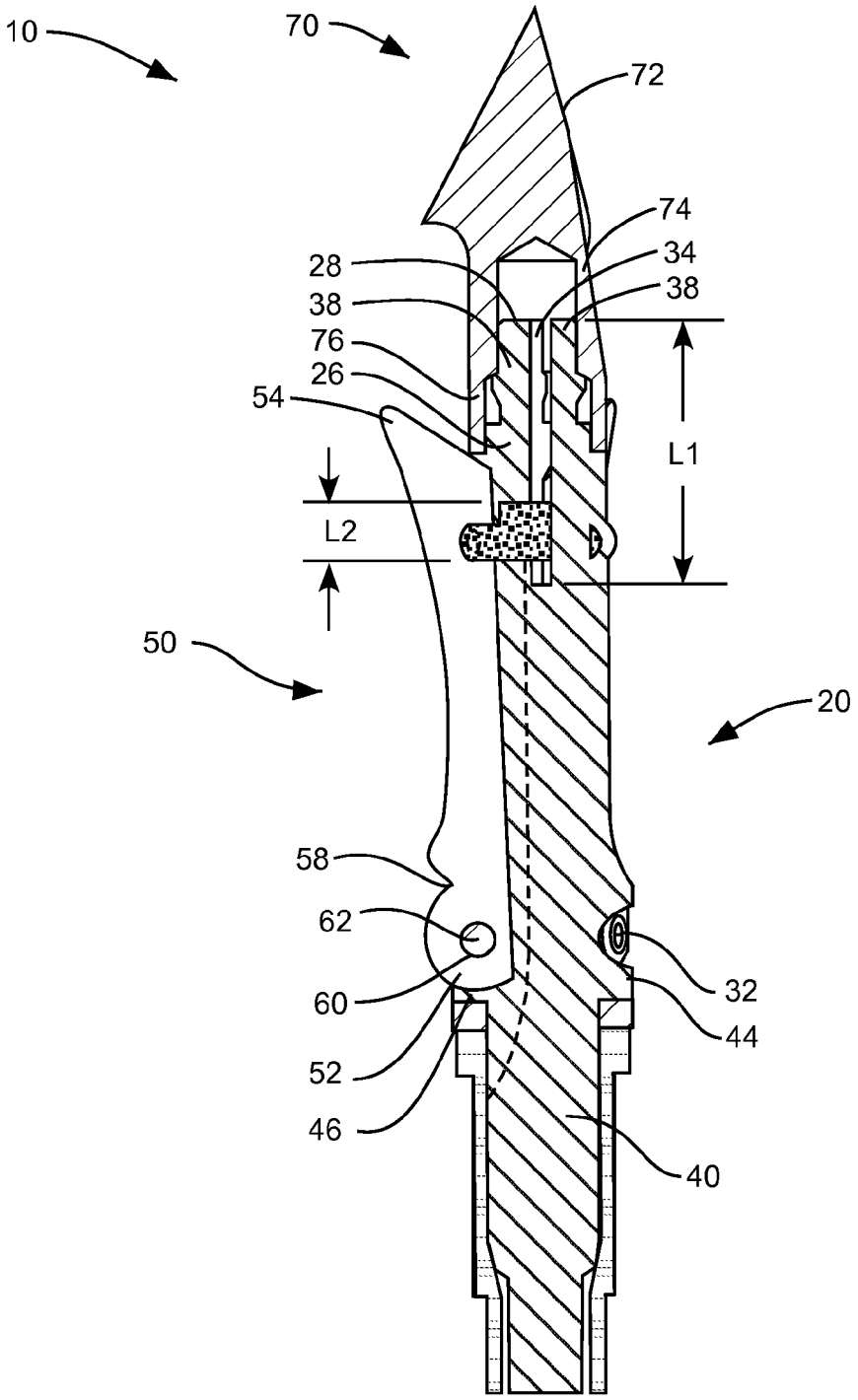
FIG. 3 is a cross section side view of the blade-opening arrowhead device of FIG. 1, shown with the blades in the retracted configuration.
Figure 4:
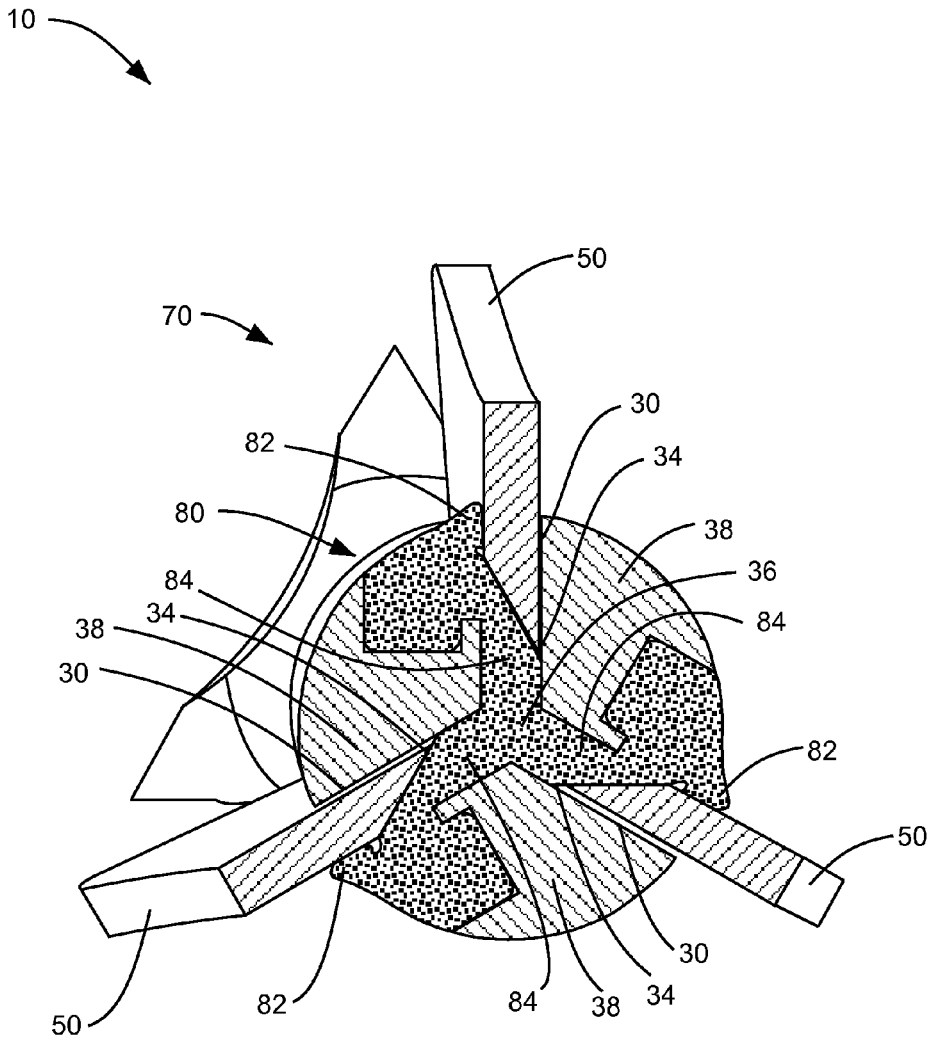
FIG. 4 is a cross section end view of the blade-opening arrowhead device of FIG. 1, shown with the blades in the retracted configuration.

As best seen in FIG. 4, the blade slots 30 in the forward portion 26 can form radial openings 34 that extend radially into the center of the arrowhead body 20 until they meet forming a central opening 36 in the forward portion 26 of the arrowhead body. The radial openings 34 and central opening 36 together can form a plurality of prongs 38 on the forward end 28 of the arrowhead body 20. As best seen in FIG. 3, the central opening 36 and radial openings 34 can extend a longitudinal length L1 from the forward end 28 toward the rearward end 24 of the arrowhead body 20.

Returning to FIGS. 1-6, the blade slots 30 in the rearward end 24 can extend radially toward the center of the arrowhead body 20, but terminate before reaching the center so that the arrowhead body 20 has a solid center 40 in the rearward portion 22.

The arrowhead body 20 can also have a flexible wedge slot 42 that can be located in the forward portion 26. As best seen in FIG. 3, the flexible wedge slot 42 can be oriented orthogonally to the longitudinally oriented blade slots 30. The flexible wedge slot 42 can include an opening 044 through which the flexible wedge 80 can extend and contact the blade 50.

A chisel tip, indicated generally at 70, with a cutting edge 72 can be coupled to the arrowhead body 20. The chisel tip can include a mount 74 that can be sized and shaped for mounting on the forward end 24 of the body. The chisel tip 70 can also have a containment ring 76 that can contain and stiffen the plurality of prongs 38 on the forward end 28 of the arrowhead body 20. The containment ring 76 can retain the plurality of prongs 38 within the mount 74 of the chisel tip 70 and can keep the prongs from moving radially outward with respect to the arrowhead body 20.

Each of the plurality of blades 50 can be disposed in a different blade slot 30. Each blade 50 can have a rearward end 52 and a forward end 54. A cutting edge 56 can extend between the forward end and the rearward end. The blades 50 can have a thickness T that tapers to a fine point on the cutting edge 56.

Additionally, each blade 50 can include a stop notch 58 positioned adjacent the rearward end 52. The stop notch 58 can be sized and shaped to contact a stop lip 46 (FIG. 3) on the arrowhead body 20 to stop rotation of the blade in an open or deployed position, as seen in FIG. 1.

The blades 50 can also include a pivot pin hole 60 (FIG. 3) disposed in the rearward end 52 of the blade 50. The pivot pin hole 60 can match up and align with the pivot pin hole 32 of the arrowhead body 20.

Figure 2:
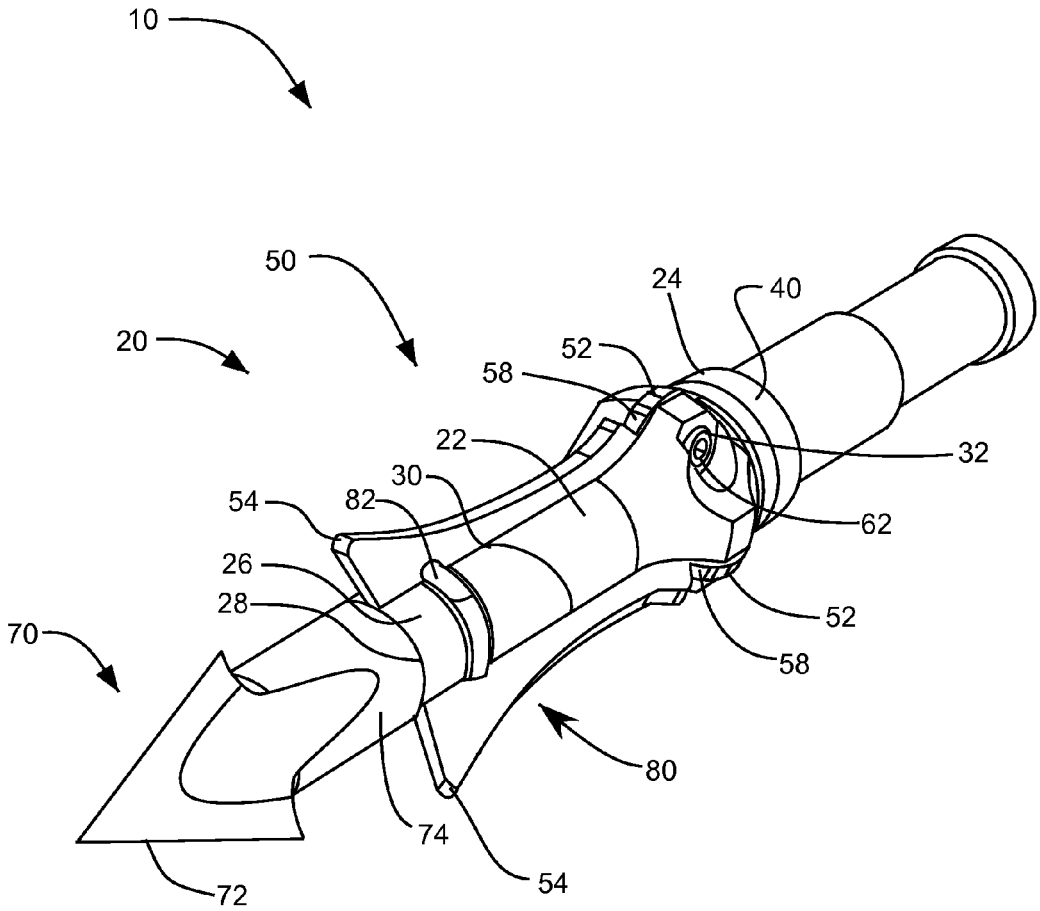
FIG. 2 is a perspective view of the blade-opening arrowhead device of FIG. 1, shown with the blades in a retracted configuration.

A pivot pin 62 can be disposed in the pivot pin hole 32 of the arrowhead body 20. The pivot pin 62 can extend through the pivot pin hole 60 of the blade 50 when the pivot pin hole 60 of the blade 50 is aligned with the pivot pin hole 32 of the arrowhead body 20. When the pivot pin 62 is disposed in the pivot pin holes 32 and 60, the pivot pin 62 rotatably connects the rearward end 52 of the blade 50 to the arrowhead body 20. When the blades 50 are pinned to the arrowhead body 20, the blades 50 can rotate between a stowed or retracted position with the blades 50 positioned in the blade slots 30, as shown in FIG. 2, and an open or deployed position with the forward end 54 of the blades 50 rotated away from the arrowhead body 20, as shown in FIG. 1.

The flexible wedge 80 can be disposed in the flexible wedge slot 42 of the arrowhead body 20. In one aspect, the flexible wedge 80 can include a flexible compressible material such as a rubber material, an elastomeric material, a plastic material, a soft metal material, a compressible polymeric material, and the like. In another aspect, the flexible wedge 80 can include a resilient uncompressible material such as a metal or composite material in the form a thin leaf spring, U spring, or the like.

The flexible wedge 80 can be sized and shaped to fill the flexible wedge slot 42. The flexible wedge 80 can apply a wedging force against the blade 50 when the blade is in the retracted position. The wedging force applied to the blade 50 can press the blade against an opposing surface to maintain the blade in the blade slot 30 in the retracted position until the forward end 54 of the blade contacts a target with sufficient force to overcome the wedging force and pivots the blade to the deployed position. In this way, the flexible wedge can contact a side of the blade to wedge the blade between the flexible wedge and the opposing surface. As shown in FIGS. 1-6, the opposing surface can be a sidewall 37 of the blade slot 30 in the arrowhead body 20.

Figure 5:
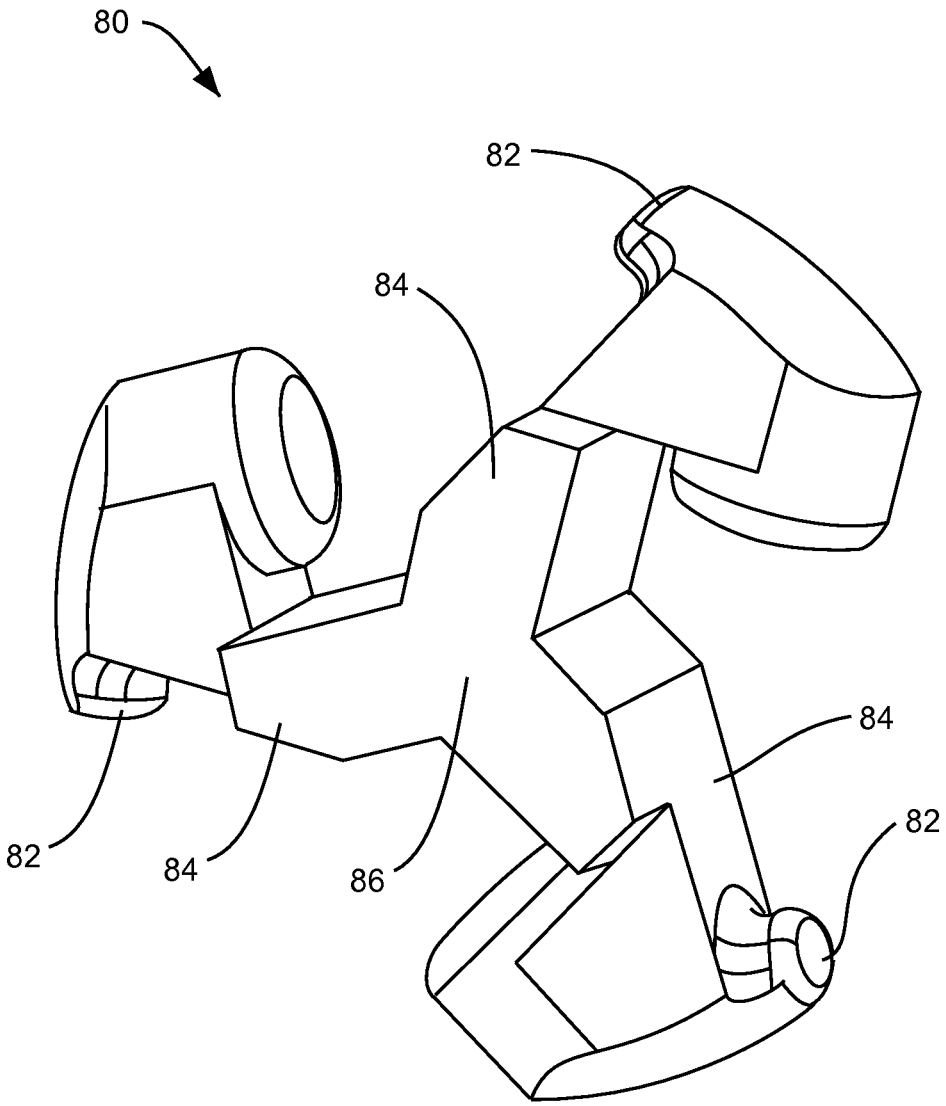
FIG. 5 is a perspective view of a flexible wedge of the blade-opening arrowhead device of FIG. 1.
Figure 6:
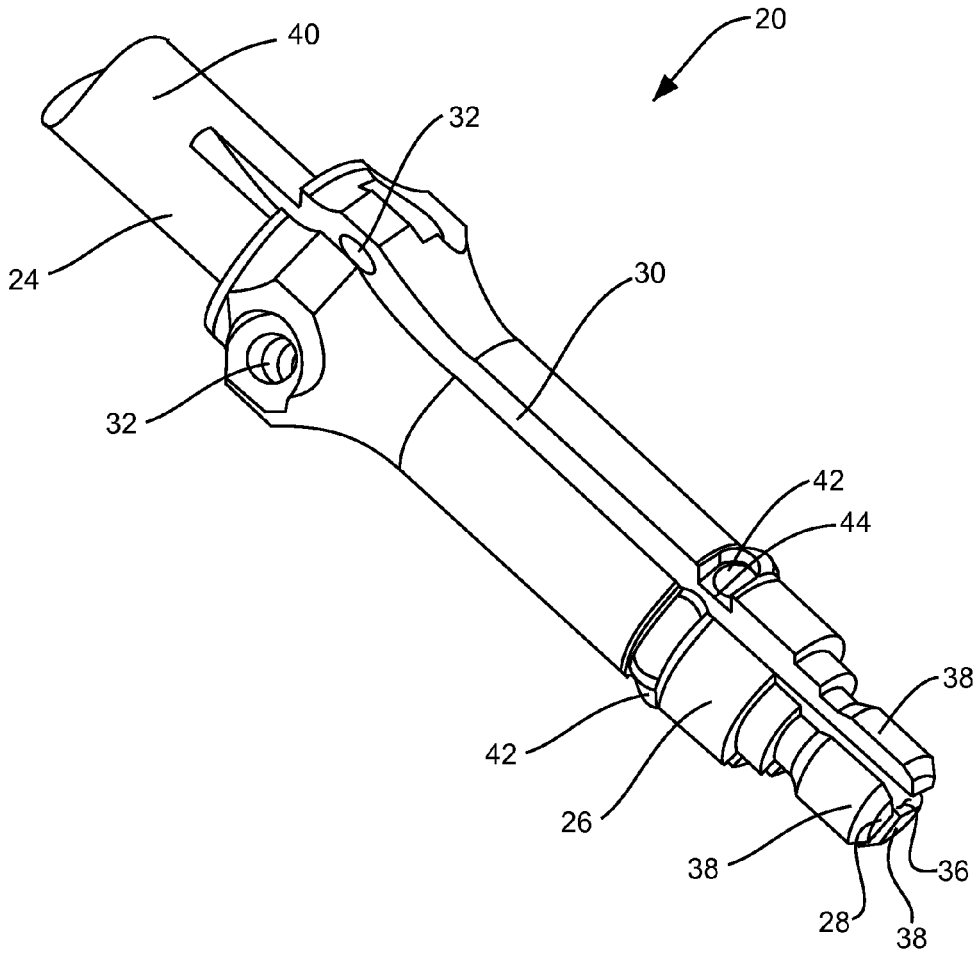
FIG. 6 is a perspective view of an arrowhead body of the blade-opening arrowhead device of FIG. 1.

Additionally, as best seen in FIGS. 4-5, the flexible wedge 80 can include a contact tab 82. In one aspect, the flexible wedge 80 can include a plurality of contact tabs 82 and each contact tab can be disposed on one of a plurality of spokes 84 of the flexible wedge. Each spoke 84 can be sized, shaped and positioned to position the contact tab 82 against the blade 50 when the blades 50 are in the retracted position. Each of the plurality of spokes 84 can correspond to the radial openings 34 formed by the plurality of blade slots 30. The spokes 84 can be joined together at a hub 86. The hub 86 can be disposed in the central opening 36 in the forward end 26 of the arrowhead body 20

In one embodiment, as best seen in FIG. 3, the flexible wedge 80 can extend for a predetermined longitudinal length L2 along the body 20 and the blade 50. The predetermined length L2 can correspond to a desired wedging force against the blade 50. For example if a stronger wedging force is desired the flexible wedge 80 can have a relatively longer longitudinal length L2 thereby contacting a greater portion of the blade 50 and thus exerting a greater wedging force against the blade 50. Similarly, if a weaker wedging force is desired, the flexible wedge 80 can have a relatively shorter longitudinal length L2 thereby contacting a relatively smaller portion of the blade 50, such that the force exerted against the blade 50 is relatively smaller.

As illustrated in FIGS. 7-11, a blade-opening arrowhead device, indicated generally at 200, is shown in accordance with another embodiment of the present invention for use in increasing the cutting diameter of the arrowhead device. The arrowhead device 200 is similar in many respects to the arrowhead device 10 shown in FIGS. 1-6 and described above. The arrowhead device 200 can include an arrowhead body, indicated generally at 220, and a plurality of blades, indicated generally at 250, and a flexible wedge indicated generally at 280. Each of the plurality of blades 250 is coupled to the arrow head body by a pivot pin, indicated generally at 60. The flexible wedge 280 can be disposed in the arrowhead body and can hold the blades in the retracted position.

The arrowhead body 220 can be generally cylindrically shaped with a rearward portion 222 extending to a rearward end 224 and a forward portion 226 extending to a forward end 228. The arrowhead body 220 can have a plurality of blade slots 230 that can extend longitudinally between the rearward end 224 and the forward end 228. Each blade slot 230 can have a corresponding pivot pin hole 232 near the rearward end.

Figure 9:
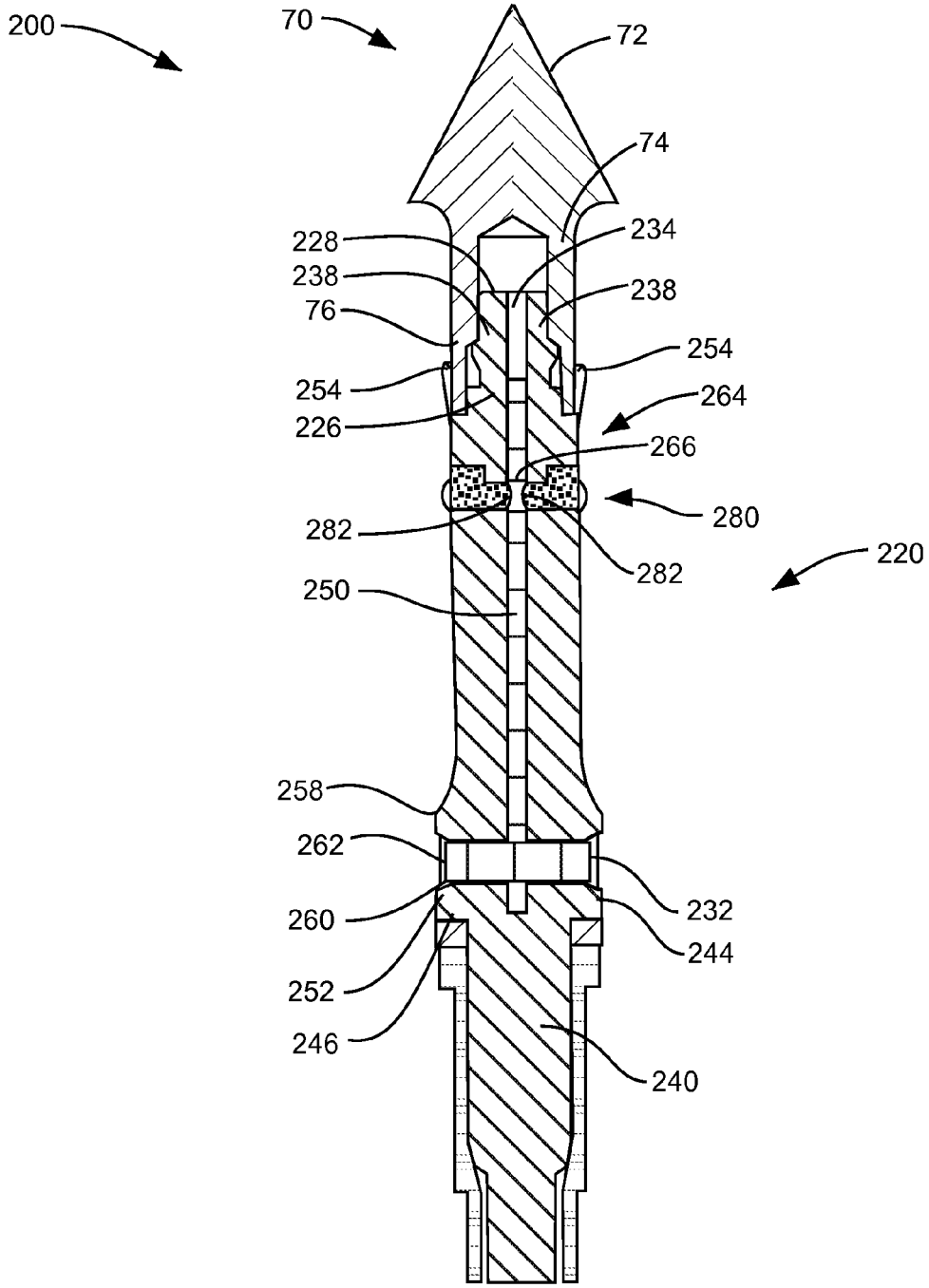
FIG. 9 is a cross section side view of the blade-opening arrowhead device of FIG. 7, shown with the blades in the retracted configuration.
Figure 11:
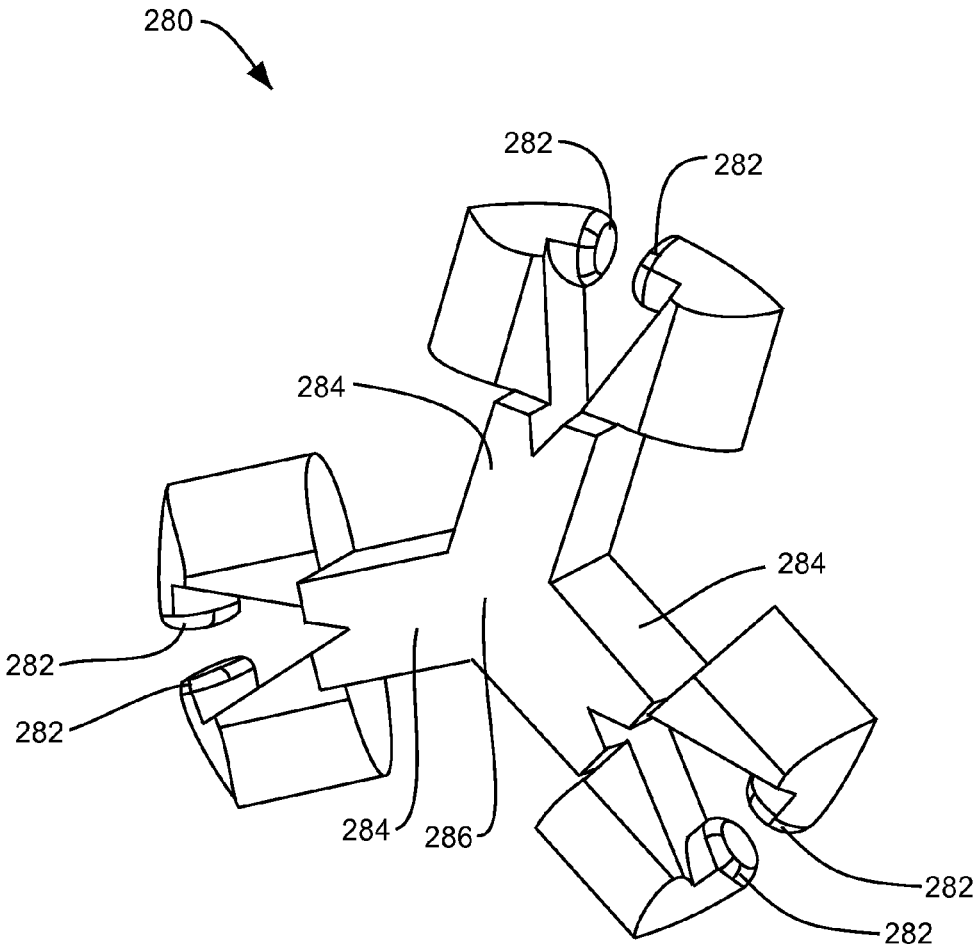
FIG. 11 is a perspective view of a flexible wedge of the blade-opening arrowhead device of FIG. 7.
Figure 12:
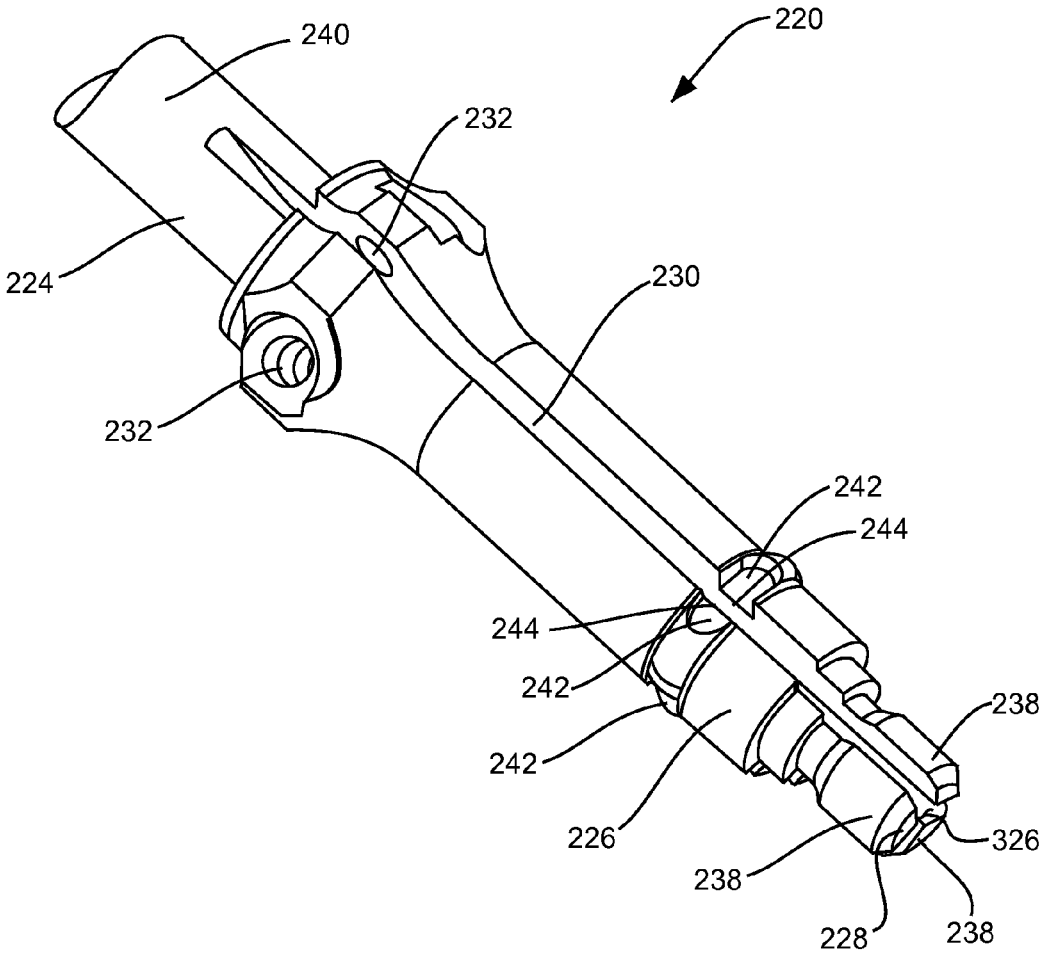
FIG. 12 is a perspective view of an arrowhead body of the blade-opening arrowhead device of FIG. 7.

As best seen in FIGS. 9 and 11, the blade slots 230 in the forward end 228 can form radial openings 234 that extend radially into the center of the arrowhead body 220 until they meet forming a central opening 236 in the forward portion 226 of the arrowhead body. The radial openings 234 and central opening 236 together can form a plurality of prongs 238 on the forward end 228 of the arrowhead body 20.

Returning to FIGS. 7-11, the blade slots 230 in the rearward end 224 can extend radially toward the center of the arrowhead body 220, but terminate before reaching the center so that the arrowhead body 220 has a solid center 240 in the rearward portion 222.

The arrowhead body 220 can also have a flexible wedge slot 242 that can be located in the forward portion 226. As best seen in FIG. 11, the flexible wedge slot 242 can be oriented orthogonally to the longitudinally oriented blade slots 230. In the embodiment shown in FIGS. 7-11, the flexible wedge slot 242 can extend across the blade slot 230 such that the flexible wedge slot 242 can have a pair of openings 244 that open into the blade slot 230 with one opening on either side of the blade slot. In this configuration, a flexible wedge 280 disposed in the flexible wedge slot 242 can extend into the blade slot 230 on either side of the blade slot and can contact the blade 250 on opposite sides of the blade when the blade is in the stowed position.

A chisel tip, indicated generally at 70, with a cutting edge 72 can be coupled to the arrowhead body 220. The chisel tip can include a mount 74 that can be sized and shaped for mounting on the forward end 224 of the arrowhead body. The chisel tip 70 can also have a containment ring 76 that can contain and stiffen the plurality of prongs 238 on the forward end 228 of the arrowhead body 220. The containment ring 76 can retain the plurality of prongs 238 within the mount 74 of the chisel tip 70 and can keep the prongs from moving radially outward with respect to the arrowhead body 220.

Each of the plurality of blades 250 can be disposed in a different blade slot 230. Each blade 250 can have a rearward end 252 and a forward end 254. A cutting edge 256 can extend between the forward end and the rearward end.

Figure 8:
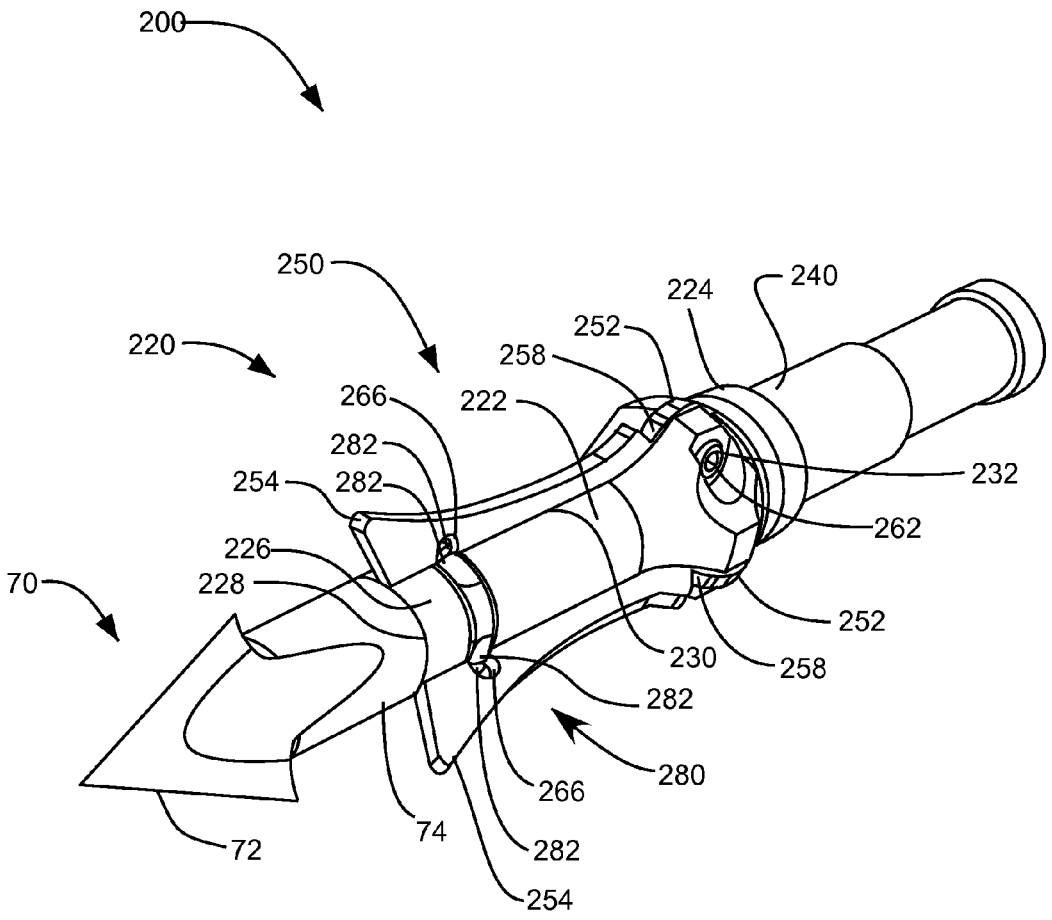
FIG. 8 is a perspective view of the blade-opening arrowhead device of FIG. 7, shown with the blades in a retracted configuration.

Additionally, each blade 250 can include a stop notch 258 positioned adjacent the rearward end 252. The stop notch 258 can be sized and shaped to contact a stop lip 246 on the arrowhead body 220 to stop rotation of the blade in an open or deployed position, as seen in FIG. 8.

The blades 250 can also include a pivot pin hole 260 disposed in the rearward end 252 of the blade 250. The pivot pin hole 260 can match up and align with the pivot pin hole 232 of the arrowhead body 220.

The blades 250 can also include an aperture, indicated generally at 264, near and adjacent to the forward end 254 of the blade. The aperture 264 in the blades 250 can be a dimple, a through hole 266, a partial slot, a through slot, and the like.

Figure 7:
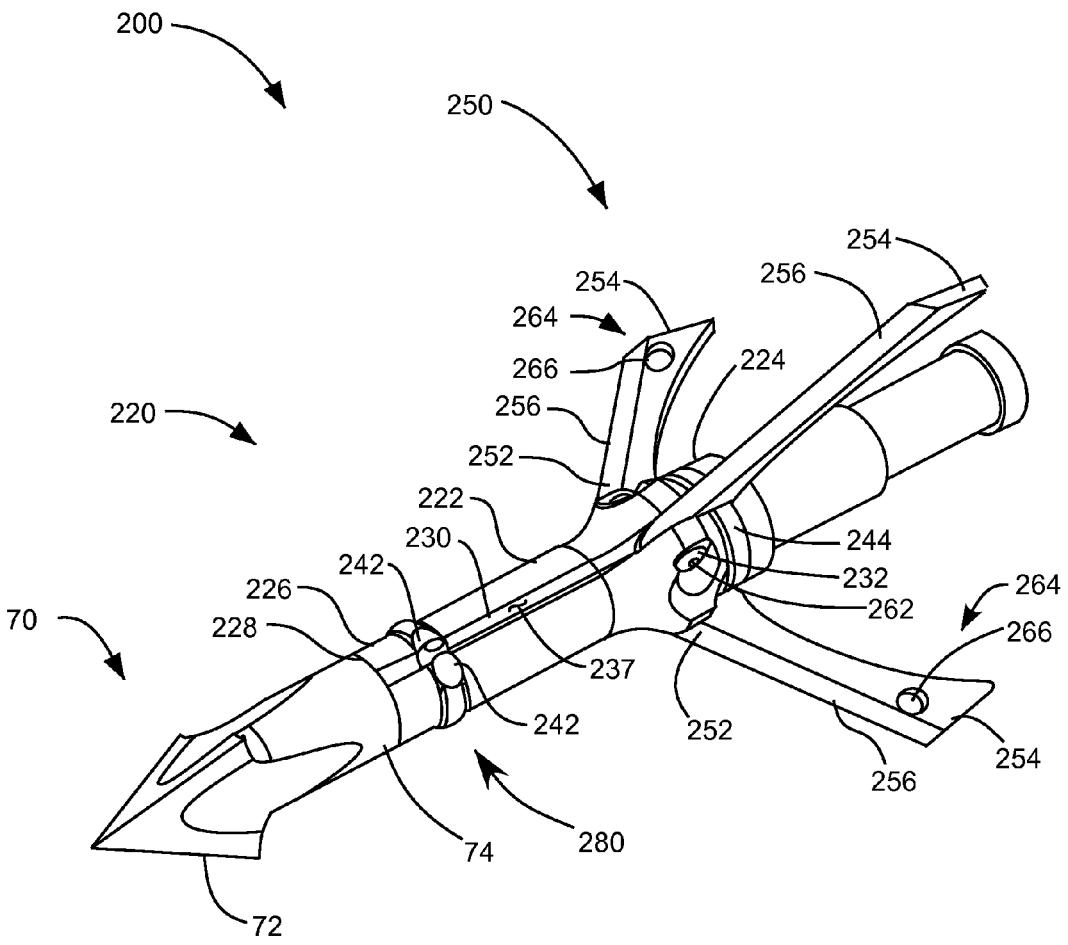
FIG. 7 is a perspective view of a blade-opening arrowhead device in accordance with another embodiment of the present invention, shown with a plurality of blades in an deployed configuration.

A pivot pin 62 can be disposed in the pivot pin hole 232 of the arrowhead body 220. The pivot pin 62 can extend through the pivot pin hole 260 of the blade 250 when the pivot pin hole 260 of the blade 250 is aligned with the pivot pin hole 232 of the arrowhead body 220. When the pivot pin 62 is disposed in the pivot pin holes 232 and 260, the pivot pin 62 rotatably connects the rearward end 252 of the blade 250 to the arrowhead body 220. When the blades 250 are pinned to the arrowhead body 220, the blades 50 can rotate between a stowed or retracted position, as shown in FIG. 8, with the blades 250 positioned in the blade slots 230, and an open or deployed position with the forward end 254 of the blades 250 rotated away from the arrowhead body 220, as shown in FIG. 7.

The flexible wedge 280 can be disposed in the flexible wedge slot 242 of the arrowhead body 220. In use, the spokes of the flexible wedge can be disposed in the radial openings of the arrowhead body and the hub of the flexible wedge can be disposed in the central opening of the arrowhead body at the forward end of the arrowhead body. The flexible wedge can then be pushed or fed longitudinally down the forward portion of the arrowhead body until the flexible wedge lines up with and fits into the flexible wedge slot in the arrowhead body.

It is a particular advantage of the arrowhead devices 10 and 200 described herein that the flexible wedges 80 and 280 extends radially outward from the center of the arrowhead body 20 and 220 instead of circumscribing the arrowhead body. If the wedge were to circumscribe the arrowhead body and the blades, as an o-ring type rention device, then when the blades are deployed, the blades would cut through the retention device and a new retention device would be required for every use of the arrowhead. Instead, the flexible wedges 80 and 280 shown and described herein allow the blade to slip in and out of the retracted, stowed position multiple times without significant wear and tear on the flexible wedge. Advantageously, re-use of the flexible wedge in this manner reduces the costs of using the arrowhead device and increases the efficiency of the archer since the archer does not need to fumble with attaching a new retention device after every use. However, in the event the flexible wedge should become worn and need replacement, the flexible wedge can easily be removed by sliding it toward the forward end of the arrowhead body and replacing it as described above.

The flexible wedge can be made from a suitable flexible material, as known in the art. In one aspect, the flexible wedge 280 can include a flexible compressible material such as a rubber material, an elastomeric material, a plastic material, a soft metal material, a compressible polymeric material, and the like.

The flexible wedge 280 can be sized and shaped to fill the flexible wedge slot 242 and extend into the blade slot on either side of the blade slot. The flexible wedge 280 can contact opposite sides of the blade and apply a wedging force against the blade 250 when the blade is in the retracted position. The wedging force applied to the blade 250 can maintain the blade in the blade slot 230 in the retracted position until the forward end 254 of the blade contacts a target with sufficient force to overcome the wedging force and pivots the blade to the deployed position.

Figure 10:
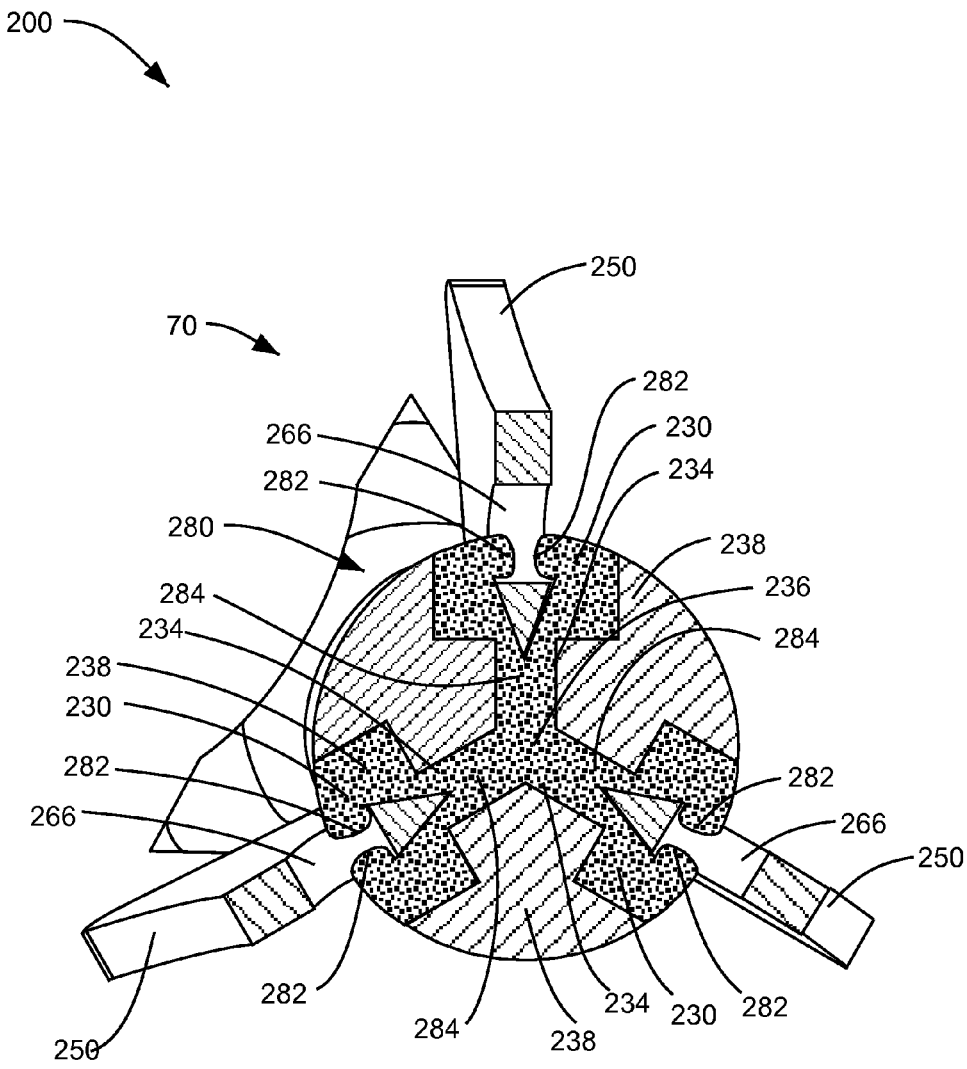
FIG. 10 is a cross section end view of the blade-opening arrowhead device of FIG. 7, shown with the blades in the retracted configuration.

Additionally, as best seen in FIGS. 9-10, the flexible wedge 280 can include a pair of contact tabs 282. In one aspect, the flexible wedge 280 can include a plurality of pairs of contact tabs 282 and each pair of contact tabs 282 can be disposed on one of a plurality of spokes 284 of the flexible wedge 280. Each spoke 284 can be sized, shaped and positioned to position the pair of contact tabs 282 against opposite sides of the blade 250 when the blades are in the retracted position. Each of the plurality of spokes 284 can correspond to the radial openings 234 formed by the plurality of blade slots 230. The spokes 284 can be joined together at a hub 286. The hub 286 can be disposed in the central opening 236 in the forward end 226 of the arrowhead body 220

As best seen in FIG. 9, the pairs of contact tabs 282 can fit within the through hole 266 disposed within the forward end 254 of the blades 250. One of the contact tabs can fit within either side of the through hole such that each of the pair of contact tabs can contact and apply a retentive wedging force on either side of the blade 250. In this way, the flexible wedge 280 can wedge the blade 250 between the locking tabs 282 of the flexible wedge, and the opposing surface against which the blade is wedged and retained is the opposing contact tab from the pair of contact tabs.

Additionally, the contact tabs 282 disposed in the through hole 266 can provide an additional retentive force on the blade 250. For example, in order for the blade to move to the deployed position the force against the blade will have to overcome both the sideways wedging force of the flexible wedge pushing against the side of the blade, and also a sheer force of the contact tab against the through hole.

Although the embodiments shown in FIGS. 7-11 and described above, show the pair of contact tabs 282 engaging the through hole 266 of the blades 250, it will be appreciated that the blade 50 without the aperture, as seen in the embodiment shown in FIGS. 1-6 and described above, can also be used with the flexible wedge 280 with the opposing contact tabs 282 pushing against the sides of the blade 50. Similarly, the flexible wedge 80 shown in FIGS. 1-6 can be used with the blade 250 of the embodiments shown in FIGS. 7-11 with the single contact tab 82 engaging the through hole 66 of the blade 250.

The present invention also provides for a method for making a blade-opening arrowhead device including obtaining an arrowhead body. A pivotal blade can be attached to the arrowhead body with the blade pivotable between a stowed position with the blade at least partially disposed within the arrowhead body and a deployed position with the blade extending away from the arrowhead body. A flexible wedge can be placed within the arrowhead body such that the flexible wedge contacts the blade in the stowed position and wedges the blade against an opposing surface. In one aspect, the opposing surface can be a blade slot in the arrowhead body, as shown in FIGS. 1-6. In another aspect, the opposing surface can be an opposing section of the flexible wedge, as shown in FIGS. 7-11.

The present invention also provides for a method for using a blade-opening arrowhead device including coupling an arrowhead body to an arrow shaft. A blade disposed on the arrowhead body can be pivoted from an open position to a retracted position. A flexible wedge can be engaged against the blade in the retracted position to provide a wedging force against the blade.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A blade-opening arrowhead device, comprising:

a) an arrowhead body having a blade slot extending longitudinally between a rearward end toward a forward end, the blade slot having a pivot pin hole near the rearward end;

b) a blade disposable in the blade slot and having a forward end, an opposing rearward end and a cutting edge extending therebetween, the blade having a corresponding pivot pin hole near the rearward end alignable with the pivot pin hole in the arrowhead body;

c) a pivot pin disposable in the pivot pin hole of the arrowhead body and the corresponding pivot pin hole of the blade to rotatably connect the rearward end of the blade to the arrowhead body such that the blade is rotatable between a retracted position with the blade stowed in the blade slot and a deployed position with the forward end of the blade rotated away from the arrowhead body;

d) a flexible wedge slot disposed in the arrowhead body and oriented substantially orthogonal to the blade slot; and e) a flexible wedge disposable in the flexible wedge slot and extending into the blade slot to contact and apply a wedging force against the blade when the blade is in the retracted position.

2. The device of claim 1, wherein the flexible wedge includes two opposing contact tabs sized and shaped to contact opposite sides of the blade to double the retentive force on the blade.

3. The device of claim 1, further comprising:

a) an aperture in the blade adjacent the forward end; and b) a contact tab disposed on the flexible wedge, sized and positioned to fit within the aperture on the blade to add a retentive force on the blade to maintain the blade in the retracted position.

4. The device of claim 3, wherein the flexible wedge includes two opposing contact tabs sized and shaped to contact opposite sides of the blade to double the retentive force on the blade.

5. The device of claim 3, wherein the aperture in the blade is selected from the group consisting of a dimple, a through hole, a partial slot, a through slot, and combinations thereof.

6. The device of claim 1, wherein the arrow head body further includes a plurality of blade slots each having an associated blade rotatably disposed therein; and wherein the flexible wedge includes a plurality of spokes, each spoke corresponding to one of the plurality of blade slots with each spoke being sized and shaped to extend a portion of the flexible wedge into the blade slot to contact and apply a wedging force against the blade disposed in the blade slot.

7. The device of claim 6, wherein each of the plurality of spokes includes a contact tab to fit within an aperture of the corresponding blade.

8. The device of claim 6, wherein each of the plurality of spokes includes a pair of opposing contact tabs to contact opposite sides of the corresponding blade.

9. The device of claim 1, wherein the flexible wedge extends for a predetermined longitudinal length along the arrowhead body and the blade with the length corresponding to a desired wedging force against the blade.

10. The device of claim 1, the blade further including a stop notch adjacent the rearward end, sized and shaped to contact a stop lip on the body to stop rotation of the blade in the open position.

11. The device of claim 1, wherein the flexible wedge includes a material selected from the group consisting of a rubber material, an elastomeric material, a plastic material, a soft metal material, a compressible polymeric material, and combinations thereof.

12. The device of claim 1, wherein flexible wedge applies a force against the blade to maintain the blade in the retracted position until the forward end of the blade contacts a target with sufficient force to overcome the wedging force and pivot the blade to the open position.

13. A blade-opening arrowhead device, comprising:

a) an arrowhead body having a plurality of longitudinal blade slots on an outer surface and a flexible wedge slot extending through a portion of the body orthogonal to the longitudinal blade slots;

b) a plurality of blades, each blade pivotally disposable in a different one of the blade slots and pivotable between a stowed position with the blade in the blade slot and a deployed position with the blade extending away from the arrowhead body; and d) a flexible wedge disposable in the flexible wedge slot and having a plurality of spokes with each spoke extending into one of the plurality of blade slots to contact and apply a retentive force against each of the plurality of blades in the retracted position.

14. The device of claim 13, wherein the flexible wedge includes two opposing contact tabs sized and shaped to contact opposite sides of the blade to double the retentive force on the blade.

15. The device of claim 13, wherein the arrowhead body has a central opening on a forward end with radial openings extending therefrom, the radial openings corresponding to the plurality of spokes on the flexible wedge and the central opening corresponding to a hub of the flexible wedge.

16. The device of claim 15, wherein the central opening and radial openings extend a longitudinal length from a forward end toward a rearward end of the arrowhead body and forms a plurality of prongs on the forward end of the arrowhead body.

17. The device of claim 16, further comprising a chisel tip having a cutting edge and a mount sized and shaped for mounting on the forward end of the body, the chisel tip having an attachment ring for attaching to and strengthening the plurality of prongs on the forward end of the arrowhead body.

18. A method for making a blade-opening arrowhead device, comprising:

a) obtaining an arrowhead body;

b) attaching a pivotal blade to the arrowhead body with the blade pivotable between a stowed position with the blade at least partially disposed within the arrowhead body and a deployed position with the blade extending away from the arrowhead body; and c) placing a flexible wedge within the arrowhead body such that the flexible wedge contacts the blade in the stowed position and wedges the blade against an opposing flexible wedge.

19. The method of claim 18, wherein the opposing surface is a blade slot in the arrowhead body.

* * * * *